US011319688B2

(12) United States Patent
Wenzl

(10) Patent No.: US 11,319,688 B2
(45) Date of Patent: May 3, 2022

(54) METHOD AND DEVICE FOR PRODUCING A FOUNDATION ELEMENT IN THE GROUND

(71) Applicant: BAUER Spezialtiefbau GmbH, Schrobenhausen (DE)

(72) Inventor: Patrik Wenzl, Stadtbergen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 17/045,144

(22) PCT Filed: Mar. 7, 2019

(86) PCT No.: PCT/EP2019/055684
§ 371 (c)(1),
(2) Date: Oct. 2, 2020

(87) PCT Pub. No.: WO2019/211029
PCT Pub. Date: Nov. 7, 2019

(65) Prior Publication Data

US 2021/0148077 A1 May 20, 2021

(30) Foreign Application Priority Data

May 4, 2018 (EP) ..... 18170765

(51) Int. Cl.

| | |
|---|---|
| ***E02D 5/36*** | (2006.01) |
| ***E02D 1/08*** | (2006.01) |
| ***E02D 5/18*** | (2006.01) |
| ***E02D 7/22*** | (2006.01) |

(52) U.S. Cl.
CPC ..... *E02D 5/36* (2013.01); *E02D 1/08* (2013.01); *E02D 5/18* (2013.01); *E02D 7/22* (2013.01); *E02D 2250/0023* (2013.01); *E02D 2300/002* (2013.01); *E02D 2300/0029* (2013.01); *E02D 2600/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,146,348 | A * | 3/1979 | Kawasaki | E02D 5/18 405/236 |
| 2010/0277290 | A1* | 11/2010 | Knudsen | E04C 3/00 340/10.52 |
| 2011/0200068 | A1 | 8/2011 | Piscsalko et al. | |
| 2012/0167487 | A1 | 7/2012 | Culp | |

FOREIGN PATENT DOCUMENTS

| | | | |
|---|---|---|---|
| CN | 103413159 | B * | 9/2016 |
| EP | 3081737 | A2 | 10/2016 |
| WO | 2014135768 | A1 | 9/2014 |

OTHER PUBLICATIONS

International Preliminary Report on Patentability issued in PCT/EP2019/055684; Date of completion of this report: Dec. 5, 2019.
International Search Report issued in PCT/EP2019/055684; dated May 21, 2019.

* cited by examiner

*Primary Examiner* — Kyle Armstrong
(74) *Attorney, Agent, or Firm* — Studebaker & Brackett PC

(57) ABSTRACT

The invention relates to a method and a device for producing a foundation element in the ground, wherein a hole is formed in the ground which is filled with a hardenable filling mass in order to form the foundation element. According to the invention provision is made in that prior to the hardening of the filling mass a data carrier is introduced into the hole, on which information on the produced foundation element is stored .

9 Claims, No Drawings

METHOD AND DEVICE FOR PRODUCING A FOUNDATION ELEMENT IN THE GROUND

The invention relates to a method for producing a foundation element in the ground, in which a hole is formed in the ground that is filled with a hardenable mass in order to form the foundation element, in accordance with the preamble of claim 1.

The invention further relates to a device for producing a foundation element in the ground having a ground working tool for producing a hole in the ground and a filling means for introducing a hardenable filling mass in order to form the foundation element in the ground, in accordance with the preamble of claim 10.

Especially when producing large-scale structures, foundation elements are produced in the ground. Such foundation elements can be bored piles or also diaphragm walls or diaphragm wall segments. For that purpose, by means of a drilling apparatus or a diaphragm wall apparatus a hole is produced in the ground which is filled with a hardenable filling mass. The foundation elements can, for example, serve to support structural loads and transfer these into deeper ground layers or provide groundwater securing so as to prevent the ingress of groundwater into a construction pit.

Due to the key significance of the foundation elements for the load-bearing capacity or groundwater barrier effect these have to be executed with great care and accuracy. In the process, the execution has to be documented so that even after the production of the foundation element or the structure as a whole a correct execution is still traceable and verifiable. For this purpose, the construction apparatus employed can, in particular, be provided with corresponding measuring and sensor means in order to document the production of a foundation element.

A drilling apparatus of such type is known from EP 3 081 737 A 2 for example. With this known drilling apparatus, e.g. a correct introduction of a support tube for a bore can be detected and documented.

Usually, the documentation is carried out by means of a computer unit in the construction apparatus, in which case the received data are initially transmitted to a center. These can then be stored by the construction company or also the client.

A generic method for producing a foundation element can be taken from US 2011/200068 A1. Prior to a hardening of the foundation element a sensor arrangement which measures parameters inside the foundation element is introduced into the hardening mass. The measured values can be stored in a data storage and transmitted externally.

The invention is based on the object to provide a method and a device for producing a foundation element in the ground, with which a particularly efficient documentation relating to the foundation element is carried out.

In accordance with the invention the object is achieved on the one hand by a method having the features of claim 1 and on the other hand by a device having the features of claim 10. Preferred embodiments of the invention are stated in the dependent claims.

In the method according to the invention provision is made in that prior to the hardening of the filling mass a data carrier is introduced into the hole, on which information on the produced foundation element is stored.

A basic idea of the invention can be seen in the fact that essential data on the produced foundation element are deposited directly on or in the foundation element. Especially in the case of large construction sites a plurality of foundation elements of several 100 pieces can be produced which can render the allocation of stored data to individual foundation elements considerably more difficult at a later stage. These difficulties are avoided by directly marking and/or storing the data in the foundation element. Moreover, the advantage is achieved that even after a longer period of time of several years, e.g. when damage occurs on a single foundation element, a rapid and targeted determination of causes can take place due to the fact that the data can be queried directly on the foundation element. In the case of a corresponding data backup it is possible even after decades, e.g. when the structure is demolished, to establish relatively easily which expenditure is to be expected for a possible removal of the foundation element.

For this purpose, the data carrier is introduced into the foundation element prior to the hardening of the filling mass and therefore prior to the hardening of the said foundation element. Thus, the data carrier is arranged in a reliable and also largely tamper-proof way in the completed foundation element.

According to a preferred embodiment of the invention provision is made in that after hardening of the filling mass the data carrier can be wirelessly queried. The data carrier can in particular be a so-called RFID-chip which, on receiving a corresponding electromagnetic signal, automatically transmits a response signal with the desired data. This enables a simple and non-destructive querying of the data carrier at any time. By preference, the data carrier is arranged in an upper region of the produced foundation element, in which case the data carrier is preferably completely surrounded by filling mass whilst still being furthermore wirelessly queryable.

According to the invention provision is made in that the information on the data carrier is permanently stored and after hardening of the filling mass the information on the data carrier is unalterable. By preference, the data carrier has a ROM storage element for this matter. This storage element is designed such that at least after the introduction into the hole or the foundation element the data stored on the said storage element can_only be read but no longer altered. Hence, the data carrier can serve as a kind of electronic certification that is particularly tamper-proof and can also be reliably queried even after longer periods of time.

By preference, the data carrier is surrounded by a housing or a sheath which provides a protection against the environment and in particular against the aggressive filling mass whilst permitting, in particular, a wireless querying on reception of an electromagnetic signal.

Basically, on the data carrier almost any type of data can be stored that are of significance to the foundation element and its production. In this connection it is preferred that as information dimensions, construction, production data and/or load-bearing capacity data of the foundation element are stored. With regard to the dimensions especially a depth and cross-sectional sizes of the produced foundation element are of particular importance. As far as the construction is concerned the type and amount of the utilized filling mass and the reinforcement materials can be stored in particular. Of particular relevance are production data such as the process of introducing the hole and introducing the filling mass. Especially the information relating to the introduction of the filling mass can provide an indication whether filling mass might have flowed unexpectedly into cavities in the ground for example. Likewise, data relating to the way the hole is produced, the necessary expenditure of time as well as the machines used and the staff employed can also be of particular importance. In particular, this can also be of relevance to an estimation of costs, for instance if a larger proportion of rock has unexpectedly appeared during the production of a hole. With regard to the load-bearing capacity data both target data and actual load-bearing capacity data can be stored which are determined on the basis of the previously stated data and relate to the specifically produced foundation element. In addition, data concerning the production date, the implementing construction company, the supplier of the filling mass etc. can be stored that may be of relevance at a later point in time.

Basically, any type of foundation element can be provided. According to an embodiment variant of the invention it is particularly advantageous for the foundation element to be produced as a bored pile by means of a drilling apparatus or as a diaphragm wall segment by means of a diaphragm wall apparatus. As a whole, the diaphragm wall segments can also be produced adjacent to each other so that a diaphragm wall, also referred to as a retaining or cut-off wall, is formed thereby.

Particularly high data security during the implementation of the method can be achieved in a preferred manner in that on completion of the production of the foundation element the data carrier is directly written by a data transmission means on the drilling apparatus or the diaphragm wall apparatus. Hence, the data carrier is automatically written and produced by the respective construction apparatus.

Basically, the data carrier thus written can then be attached in a suitable way by an operator to an upper region of the foundation element, in particular it can be pressed into the filling mass while still soft. According to a further development of the invention a further increase of the reliability is achieved in that the written data carrier is directly introduced into the hole in the ground by a delivery means on the drilling apparatus or the diaphragm wall apparatus. For instance, this can be carried out by a manipulator arm or preferably by an insertion tube or an insertion line solely by the force of gravity or by compressed air. Basically, an introduction of the data carrier via the regular concrete pump with the filling mass is possible too. In particular, several data carriers containing the information can also be introduced into a foundation element, whereby an increased data security is provided.

According to a method variant of the invention a particularly reliable arrangement of the data carrier is attained in that the data carrier is attached to a reinforcement element which is introduced into the hole in order to form the foundation element. By preference, the data carrier can be fixed on the reinforcement element, more particularly a steel beam or a reinforcement cage, by a suitable holder before the reinforcement element is placed into the hole filled with filling mass.

The invention furthermore comprises a foundation element produced according to the previously described method, wherein the foundation element is formed by filling a hole in the ground with a hardenable mass, wherein the formed foundation element is provided with a data carrier, on which information on the produced foundation element is stored.

The previously described advantages with regard to a reliable tamper-proof data allocation to a foundation element can be achieved thereby.

The device according to the invention for producing a foundation element in the ground is characterized in that a data transmission means is provided for transmitting information on the produced foundation element to a data carrier which is designed to be arranged and remain in the foundation element after hardening of the filling mass.

The device can, in particular be used to carry out the previously described method. The advantages described beforehand can be achieved thereby.

A preferred embodiment of the invention resides in the fact that a delivery means is provided, with which the data carrier with the stored information can be introduced into the hole in the ground prior to the hardening of the filling mass. The delivery means can be a manipulator arm or a feed means, e.g. having a feed tube or a feed line. For that matter, the data carrier can be introduced into the hole by the force of gravity or by way of compressed air. This can be effected by placing it into the hole prior to the filling of the filling mass or afterwards into the still soft filling mass before the hardening.

Basically, the device can be any suitable construction apparatus for producing a foundation element by filling a hole. It is especially preferred that the device is designed as a drilling apparatus or a diaphragm wall apparatus. The diaphragm wall apparatus can be a diaphragm wall grab or preferably a diaphragm wall cutter.

The invention claimed is:

1. A method for producing a foundation element in the ground, in which a hole is formed in the ground that is filled with a hardenable filling mass in order to form the foundation element, wherein prior to the hardening of the filling mass a data carrier is introduced into the hole and on the data carrier information on the produced foundation element is permanently stored, wherein on the data carrier at least dimensions of the produced foundation element are permanently stored as information, wherein after hardening of the filling mass the information on the data carrier is unalterable as an electronic certification, wherein the foundation element is produced as a bored pile by means of a drilling apparatus or as a diaphragm wall segment by means of a diaphragm wall apparatus, and wherein on completion of the production of the foundation element the data carrier is directly written by a data transmission means on the drilling apparatus or the diaphragm wall apparatus.

2. The method according to claim 1, wherein after hardening of the filling mass the data carrier can be wirelessly queried.

3. The method according to claim 1, wherein the data carrier is designed as an RFID-chip which, on receiving a corresponding electromagnetic signal, automatically transmits a response signal with the stored information.

4. The method according to claim 1, wherein as information construction, production data and/or load-bearing capacity data of the foundation element are stored.

5. The method according to claim 1, wherein the written data carrier is directly introduced into the hole in the ground by a delivery means on the drilling apparatus or the diaphragm wall apparatus.

6. The method according to claim 1, wherein the data carrier is attached to a reinforcement element which is introduced into the hole in order to form the foundation element.

7. A foundation element, produced pursuant to a method according to claim 1, which is formed by filling a hole in the ground with a hardenable mass, wherein the formed foundation element is provided with a data carrier, on which information on the produced foundation element is permanently stored as an electronic certification.

8. A device for producing a foundation element in the ground, in particular pursuant to a method according to claim 1, having a ground working tool for producing a hole in the ground and a filling means for introducing a hardenable filling mass in order to form the foundation element in the ground, wherein the device is designed as a drilling apparatus or a diaphragm wall apparatus, in that a data transmission means is provided for transmitting information on the produced foundation element to a data carrier which is designed to be arranged and remain in the foundation element after hardening of the filling mass, and in that on completion of the production of the foundation elements the data carrier is written by the data transmission means on the drilling apparatus or the diaphragm wall apparatus.

9. The device according to claim 8, wherein a delivery means is provided, with which the data carrier with the stored information is introduced into the hole in the ground prior to the hardening of the filling mass.

* * * * *